United States Patent [19]

Bashark

[11] 3,939,666

[45] Feb. 24, 1976

[54] STILE AND MULLION HEATER CONTROL

[75] Inventor: Larry Thomas Bashark, St. Joseph, Mich.

[73] Assignee: Whirlpool Corporation, Benton Harbor, Mich.

[22] Filed: Sept. 30, 1974

[21] Appl. No.: 510,485

[52] U.S. Cl. ..... 62/150; 62/176; 219/398

[51] Int. Cl.[2] ..... F25D 21/08

[58] Field of Search ..... 62/150, 176, 275; 307/252 N; 236/44 C, 44 R, 1 E; 219/398

[56] References Cited

UNITED STATES PATENTS

| | | | |
|---|---|---|---|
| 2,647,374 | 8/1953 | Stoner | 62/150 |
| 3,340,460 | 9/1967 | Clarke et al. | 307/252 N |
| 3,371,231 | 2/1968 | Burley | 307/252 N |
| 3,443,395 | 5/1969 | Schweiger | 62/275 X |
| 3,460,352 | 8/1969 | Lorenz | 62/176 X |
| 3,474,790 | 10/1969 | Benzinger | 236/44 R |
| 3,717,300 | 2/1973 | Evalds | 236/1 E |

*Primary Examiner*—William E. Wayner
*Attorney, Agent, or Firm*—Wegner, Stellman, McCord, Wiles & Wood

[57] ABSTRACT

A control for selectively energizing a plurality of electrically operable devices in a refrigeration apparatus. The control senses an ambient condition and correspondingly controls the energization of the electrical devices. In the disclosed embodiment, the electrical devices comprise stile and mullion heaters for controlling condensation on the refrigeration unit cabinet with the control being responsive to the ambient humidity conditions in effecting control of the energization of the heaters. The control is arranged to selectively energize both heaters with full operating current, or only one of the heaters and at reduced current, depending on the sensed humidity and temperature conditions. In the illustrated embodiment, the control utilizes rectifiers in effecting the current control with one of the rectifiers being a gated rectifier responsive to the sensed ambient air conditions.

9 Claims, 5 Drawing Figures

12
10
13
16
11
17
15
14
18
19
21
22
23
20
24
DEF. TIMER 28
25
24
26
29
31
28
27

30
29
31
25
27
26
28

KITCHEN R.H. %
70
60
50
40
ON
OFF
BREAK POINT-HALF WAVE HEATED MULLION
BREAK POINT UNHEATED STILE
CONTROL SWITCH CURVE
70
90
110
KITCHEN AMBIENT TEMP. °F

120 VAC
32
36
L1
L2
37
33
EVAPORATOR HEATER
35
38
FREEZER THERM.
40
39
MULLION HEATER
17
24
41
STILE HEATER
42
55
43
34
44
50
19
51
49
25
48
46
45
47

STILE AND MULLION HEATER CONTROL

BACKGROUND OF THE INVENTION

1. Field of the Invention

This invention relates to refrigeration apparatus and in particular to controls for use therein.

2. Description of the Prior Art

In one conventional form of refrigeration apparatus, such as refrigerator and freezer apparatus, stile and mullion heaters are provided for effecting anti-condensation heating of the cabinet adjacent the doors. Because of recent energy supply problems, it has been found desirable to improve the efficiency of such anti-condensation heaters. One effort in this respect has been to provide a manual switch allowing the user of the apparatus to manually de-energize the heaters when desired, such as under low ambient humidity conditions.

SUMMARY OF THE INVENTION

The present invention comprehends an improved apparatus control such as for use in controlling the mullion and stile heaters in refrigeration apparatuses wherein the operation of the heaters is automatically controlled as a function of sensed ambient humidity and temperature conditions.

The control means is arranged to pass fully operating current concurrently to each of the heaters and selectively concurrently de-energize one of the heaters and cause reduced current flow to the other of the heaters as an incident of the sensor means sensing a preselected humidity condition. Thus, more broadly, the invention comprehends providing such a control means for automatically controlling energization of first and second electrically operable devices in an apparatus wherein the sensor means senses a selected condition affecting the apparatus with the automatic control being related to the sensor means sensing a preselected value of that condition.

More specifically, the present invention comprehends utilizing a novel arrangement of rectifiers to effect selective full wave or half wave energization of one heater and normal full heating operation with half wave current, or de-energization of the other heater. In the specific embodiment, the mullion heater is selectively energized with full wave current or half wave current and the stile heater is selectively fully energized with half wave current or de-energized as a function of the control in response to the sensed ambient humidity condition.

The control may be disposed adjacent the path of flow of air to the refrigeration unit condenser for improved sensing of the ambient air conditions. The control is preferably spaced from the machinery of the refrigeration apparatus so as to be independent of the temperature condition thereof.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 1:
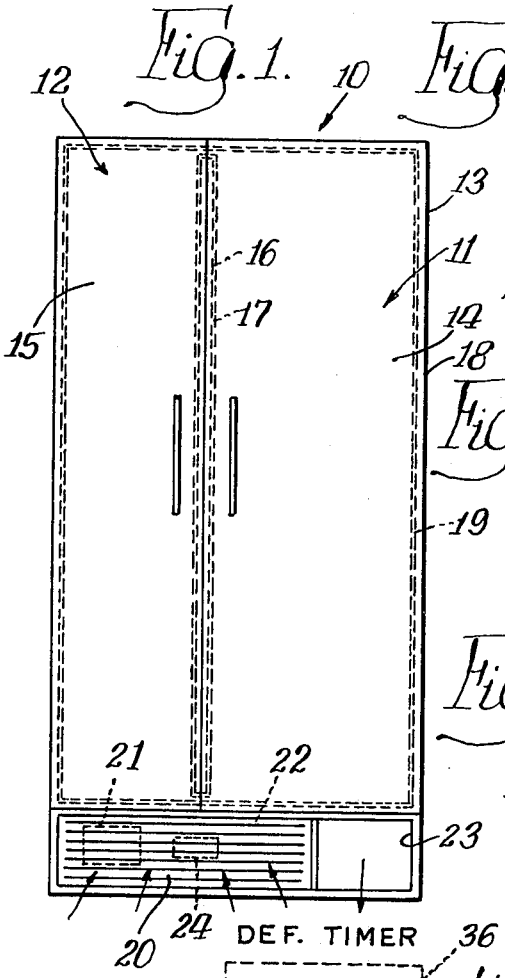
FIG. 1 is a front elevation of a refrigeration apparatus having a control means embodying the invention.

In the exemplary embodiment of the invention as disclosed in the drawing, an apparatus generally designated 10 illustratively comprises a refrigeration appliance defining a side-by-side refrigerator portion 11 and freezer portion 12. The apparatus cabinet 13 is provided with a refrigerator door 14 and a freezer door 15 providing access to the respective portions. The cabinet mullion 16 between the two portions is provided with a mullion heater 17 and the cabinet stile 18 is provided with a stile heater 19 of conventional construction for controlling condensation on the cabinet adjacent the door seals. The apparatus further defines a lower refrigeration space 20. The refrigeration machinery is mounted within space 20 and illustratively includes a condenser 21 which is cooled by air flowing into space 20 through a lint grill 22, the air being discharged through a front opening 23 after passing in heat transfer relationship with the condenser.

As discussed above, for improved energy efficiency in the use of the refrigeration apparatus, a manual switch has heretofore been provided for de-energizing the anti-condensation heaters 17 and 19 under low ambient humidity conditions. The present invention comprehends an improved control for such heaters, or similar apparatus electrical devices, which automatically controls the energization and de-energization thereof in accordance with a sensed ambient condition herein comprising the ambient humidity and temperature condition. The control generally designated 24 is preferably disposed in the space 20 in the flow path of the air delivered through the grill 22 to the condenser 21 for providing a constant delivery of the ambient air to the control for improved sensing of the condition thereof. The control is preferably spaced forwardly of the heat producing apparatus of the refrigeration appliance so as to be substantially unaffected by the temperature conditions thereof.

Figure 2:
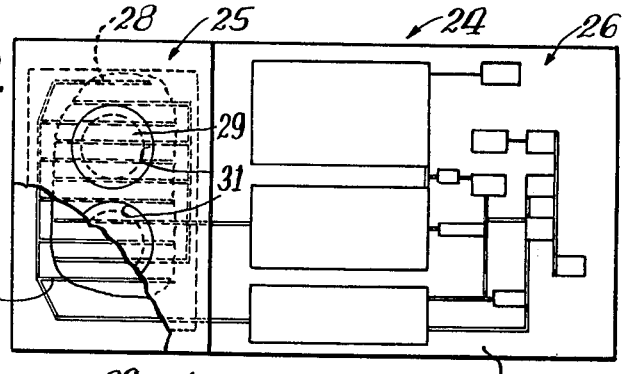
FIG. 2 is a plan view of the control means with a portion cut away to better illustrate the invention.
Figure 3:
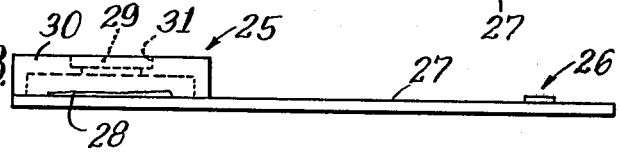
FIG. 3 is a front elevation thereof.

The control means includes a sensor means generally designated 25 and a power circuit means generally designated 26 carried on a common base 27, as illustrated in FIGS. 2 a timer motor 37 for selectively operating switch 33 in a conventional manner. The evaporator heater may be connected in series with a bimetal switch 38 to power supply lead L2.

The compressor motor 39 of the refrigeration apparatus may be connected in series with a freezer thermostat switch 40 between lead 34 and power supply lead L2.

Figure 5:
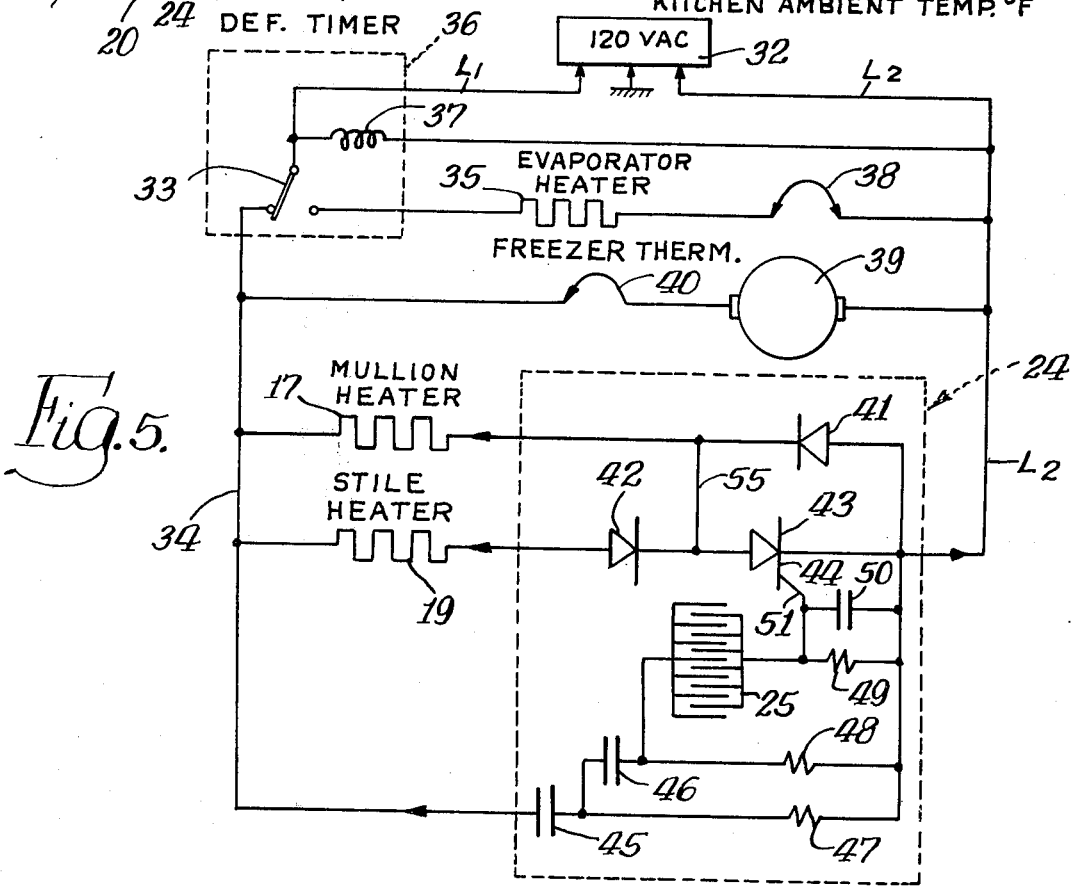
FIG. 5 is a schematic diagram of the electrical wiring of the apparatus and control.

Mullion heater 17 is connected from lead 34 to control 24 and stile heater 19 is connected from lead 34 to control 24, as shown in FIG. 5, for selective control of the energization thereof from lead 34 to power supply lead L2. Control 24 includes a first diode 41 connected between mullion heater 17 and power supply lead L2. A second diode 42 is connected in series with a gated rectifier 43 illustratively comprising a silicon controlled rectifier having a gate 44. Stile heater 19 is connected in series with the series connected diode 42 and SCR 43 to power supply lead L2. Mullion heater 17 is connected to the cathode of diode 41 and to the anode of SCR 43 through lead 55. The variable resistance sensor 25 is connected to lead 34 through a first capacitor 45 and a second capacitor 46. Capacitor 45 is connected in series with a first resistor 47 to power supply lead L2. Second capacitor 46 is connected from between capacitor 45 and resistor 47 through a second resistor 48 to power supply lead L2. Sensor 25 is connected from between capacitor 46 and resistor 48 to a parallel circuit including a third resistor 49 and a third capacitor 50 which, in turn, is connected to power supply lead L2. A lead 51 from between sensor 25 and the parallel circuit of resistor 49 and capacitor 50 is connected to the gate 44 for controlling the operation of SCR 43 as a function of the variable resistance of sensor 25.

When the resistance of the sensor 25 is low, as occurs when the relative humidity of the ambient air is high, the SCR 43 is gated each half cycle thus permitting half wave current to flow through the SCR from both heaters 17 and 19. At the same time, alternate half wave current 180° out of phase with the current through SCR 43 is conducted through mullion heater 17 and diode 41 so that, at this time, full wave current passes through the mullion heater thereby normally energizing the mullion heater at full power. The resistance of the stile heater is preselected so as to provide the desired normal heating operation with the half wave current energization thereof permitted by the series connected diode 42 and conductive SCR 43. Thus, at this time, both heaters are operating in normal full energized condition.

However, when the humidity sensed by sensor 25 decreases so as to increase the resistance thereof, the SCR 43 is turned off so as to prevent current flow to stile heater 19 and permit only half wave current flow through mullion heater 17 through the diode 41. Thus, depending on the sensed humidity condition, the electrically operable means of the apparatus 10 controlled by control 24 is selectively energized for full power operation or partial power operation.

In the illustrated embodiment, the parameters of the capacitors and resistors may be as follows:

| | |
|---|---|
| Capacitor 45 | .022 microfarads |
| Capacitor 46 | .015 microfarads |
| Capacitor 50 | .01 microfarads |
| Resistor 47 | 150 kilohms |
| Resistor 48 | 600 kilohms |
| Resistor 49 | 2.7 kilohms |

The capacitor and resistor circuitry provides a phase shift so as to control the SCR 43 to provide a full 180° conduction angle when the resistance 25 is low. Capacitor 50 further prevents radio frequency voltage which may be present on the line voltage from inadvertently triggering SCR 43. To effect such phase shift, capacitor 45 and resistor 47 effect a first 45° shift with capacitor 46 and resistor 48 effecting a second 45° shift to provide a 90° phase shift to the gate 44 of SCR 43. The phase shifting circuit further eliminates radio frequency disturbances from being generated by the control.

Under low humidity conditions, the variable resistor sensor 25 may have a resistance of at least 400 kilohms and under relatively high humidity conditions, the resistance thereof may be less than approximately 200 kilohms to provide the desired automatic control of the heater energization.

Figure 4:
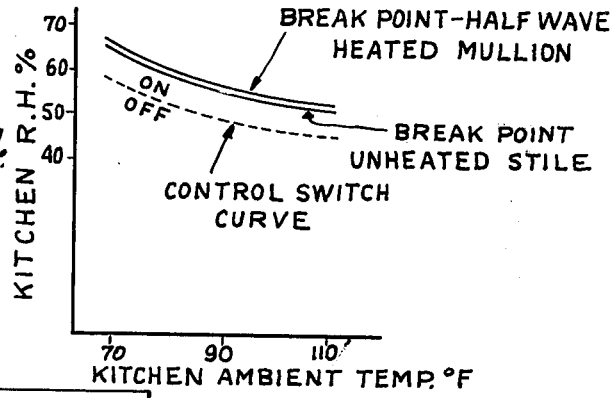
FIG. 4 is a graph illustrating the operating characteristics of the heaters and switch.

As shown in FIG. 4, the response characteristics of the film 28 may be preselected to match the break point sweat curves of the apparatus over an ambient temperature range of approximately 70° to 110° F. The break point curves illustrated in FIG. 4 indicate the relationship of the ambient humidity and ambient temperature and illustrate the conditions above which the refrigerator cabinet will sweat under the different humidity and temperature conditions. The control 24 is arranged to assure energization at full power of both heaters 17 and 19 when the relative humidity of the ambient air is within about 5% of the break point value. As the break point curves with half wave power supplied to the mullion heater 17 closely coincides to the break point curve with the stile heater de-energized, a single sensor 25 and a single SCR 43 may be efficiently utilized in switching both of the heaters simultaneously.

Thus, the invention comprehends correlating a sensor element with suitable diode control power elements to provide an improved automatic control of electrical devices, such as refrigerator cabinet heaters. The control is extremely simple and economical of construction while providing the improved highly desirable energy-saving functioning.

By providing a minimum of half wave power to the mullion heater 17 at all times the control 24 overcomes a limitation of the conventional manual on-off switch in which full power is applied to both the stile and mullion heasters, thus wasting power during the wideranging ambient and seasonal conditions when half wave power applied to the mullion heater 17 is both necessary and sufficient to prevent condensation. An alternative to the preferred embodiment is to replace the SCR 43 with a manual switch, retaining diodes 41 and 42. Thus half wave power is applied to the mullion heater 17 through diode 41 when the switch is in the off position. The preferred embodiment provides more optional power savings by automatically switching the heater power whenever necessary without depending upon a manual operation.

The foregoing disclosure of specific embodiments is illustrative of the broad inventive concepts comprehended by the invention.

Having described the invention, the embodiments of the invention in which an exclusive property or privilege is claimed are defined as follows:

1. In an apparatus having a cabinet with a refrigerated enclosure, and electrical heater means for preventing water condensation on the cabinet from ambient air surrounding the cabinet, control means for automatically controlling said heater means as a function of a condition of said ambient air, said control means comprising: power circuit means for providing electrical power to said heater means, said power circuit means providing a preselected full power to said heater means in a first state and a preselected partial power to said heater means in a second state; means for sensing said condition of the ambient air; and circuit means responsive to said sensing means for placing said power circuit means at all times selectively in one or the other of said first and second states as a function of said sensed ambient air condition.

2. The apparatus control means of claim 1 wherein the heater means comprises first and second heaters.

3. The apparatus control means of claim 1 wherein the heater means comprises first and second heaters and the power circuit means is arranged to de-energize one of the heaters and partially energize the other of the heaters in said second state.

4. The apparatus control means of claim 1 wherein the heater means comprises separate stile and mullion heaters.

5. The apparatus control means of claim 1 wherein the heater means comprises a plurality of separate heaters and the power circuit means is arranged to selectively de-energize at least one thereof in said second state.

6. The apparatus control means of claim 1 wherein the apparatus cabinet defines a machinery space containing electrically operable power means, the sensing means being disposed in said machinery space in spaced relationship to the electrical power means.

7. The apparatus control means of claim 1 wherein the apparatus cabinet defines a machinery space containing electrically operable power means and having means for flowing air into said machinery space in heat exchange relationship to the electrically operable power means, the sensing means being disposed in said machinery space in the air flow path at the inlet to said machinery space.

8. The apparatus control means of claim 1 wherein the heater means comprises a plurality of separate heater elements and the sensing means comprises a single sensor element, and said power circuit means is responsive to said single element for controlling the plurality of heater elements.

9. The apparatus control means of claim 1 wherein the apparatus comprises a refrigeration unit having a heat transfer portion and means for flowing ambient air in heat transfer association with said portion, the sensing means being disposed to be contacted by the flowing air prior to the delivery thereof to the heat transfer means.

* * * * *